United States Patent [19]

Hildre

[11] Patent Number: 4,982,680

[45] Date of Patent: Jan. 8, 1991

[54] HYDRAULIC ACTUATOR

[75] Inventor: Hans P. Hildre, Tennfjord, Norway

[73] Assignee: Tenfjord A.S., Tennfjord, Norway

[21] Appl. No.: 362,483

[22] Filed: Jun. 7, 1989

[30] Foreign Application Priority Data

Jun. 10, 1988 [NO] Norway ..... 882578

[51] Int. Cl.[5] ..... F01C 9/00

[52] U.S. Cl. ..... 114/150; 92/120

[58] Field of Search ..... 92/120, 121, 122, 125, 92/124, 140; 114/150 X

[56] References Cited

U.S. PATENT DOCUMENTS

| | | | |
|---|---|---|---|
| 2,608,060 | 8/1952 | Smith | 114/150 |
| 3,995,536 | 12/1976 | Tenfjord | 92/120 |
| 4,045,958 | 9/1977 | Wells | 92/120 |
| 4,484,511 | 11/1984 | Dibrell | 92/120 |

FOREIGN PATENT DOCUMENTS

| | | | |
|---|---|---|---|
| 0201470 | 11/1986 | European Pat. Off. | 114/150 |
| 2453680 | 6/1975 | Fed. Rep. of Germany | 92/120 |
| 0600323 | 4/1978 | U.S.S.R. | 92/120 |
| 1456614 | 11/1976 | United Kingdom | 92/120 |

*Primary Examiner*—Edward K. Look
*Assistant Examiner*—Thomas Denion
*Attorney, Agent, or Firm*—Vaden, Eickenroht, Thompson & Boulware

[57] ABSTRACT

Hydraulic wing actuator for turning movement of a spindle, especially a rudder stock (3), comprising a lower part (2) fixed to the ship hull and an upper part (1) secured to the lower part and which together define a substantially torus shaped guiding path for wings (8, 7) connected with the lower part and the rudder stock respectively, where a ball shaped hub (4) being secured to the rudder stock (3) and journalled slideably in the lower and upper parts, creating the radially inward facing, concave limitation of the guiding path, which remaining torus shaped part being formed by the upper and lower parts, at least one fixed partition wall (5) being connected with the lower part and the upper part and comprising to both sides protruding wings (8) abutting tightly to the guiding path, whereby one fluid conduit leads to each side of each fixed partition wall (5) for alternatively pressurizing or depressing the two spaces on both sides of the partition walls, and at least one carrier (6) being fixedly connected with the hub and arranged in the guiding path, comprising to both sides protruding and tightly against the guiding path abutting wings (7) connected with the carriers and being displaceable together with the carriers.

2 Claims, 1 Drawing Sheet

HYDRAULIC ACTUATOR

FIELD OF THE INVENTION

The present invention is related to a wing actuator for turning movement of a spindle, such as a rudder stock, according to the preamble of the claims.

Actuators for turning movement of rudder stocks are known in many different embodiments, as mechanical as well as hydraulic devices, of which a majority is designed for rectilinear movement of the actuator. In such cases the force transferred to the rudder stock is dependent on the position of the rudder stock in relation to the transmission devices for the actuator. Also known, however, are hydraulical actuators avoiding the aforementioned disadvantage in providing a hydraulic cylinder arranged as a torus shaped guiding path around the rudder stock. The transmission of the forces from the hydraulic fluid in the guiding path, to a turning movement of the rudder stock is, however, circumstantial and involves several single parts, making the embodiment expensive and to a certain extent decreasing the accuracy of the movement.

SUMMARY OF THE INVENTION

The rudder stock is, additionally to a turning movement, undertaking an edging movement due to the forces against the rudder, which forces will bend the rudder stock between upper and lower bearings. Due to this fact the rudder stock from time to time will move out of its ideal position where the axis of the rudder stock is aligned with the axis through upper and lower bearings. An actuator for turning movement of the rudder stock therefore must be able to adapt this movement of the rudder stock and ensure that the function of the actuator not substantially is influenced when the rudder stock is moved out of its normal position.

With the hydraulic wing actuator according to the present invention is ensured that the conversion of the pressure from the hydraulic fluid to a turning movement of a rudder stock is achieved, and at the same time an adequate upper bearing of the rudder stock which is simple and occupies little space, is provided. The aforementioned advantages are achieved with the hydraulic wing actuator according to the present invention as described by the features defined in the claims.

BRIEF DESCRIPTION OF THE DRAWINGS

In the drawing FIG. 1 discloses a side view, partly in section, of the wing actuator according to the invention and FIG. 2 discloses a sectional view of the wing actuator, as seen along a section II—II of FIG. 1.

DESCRIPTION OF THE PREFERRED EMBODIMENT

Figure 1:
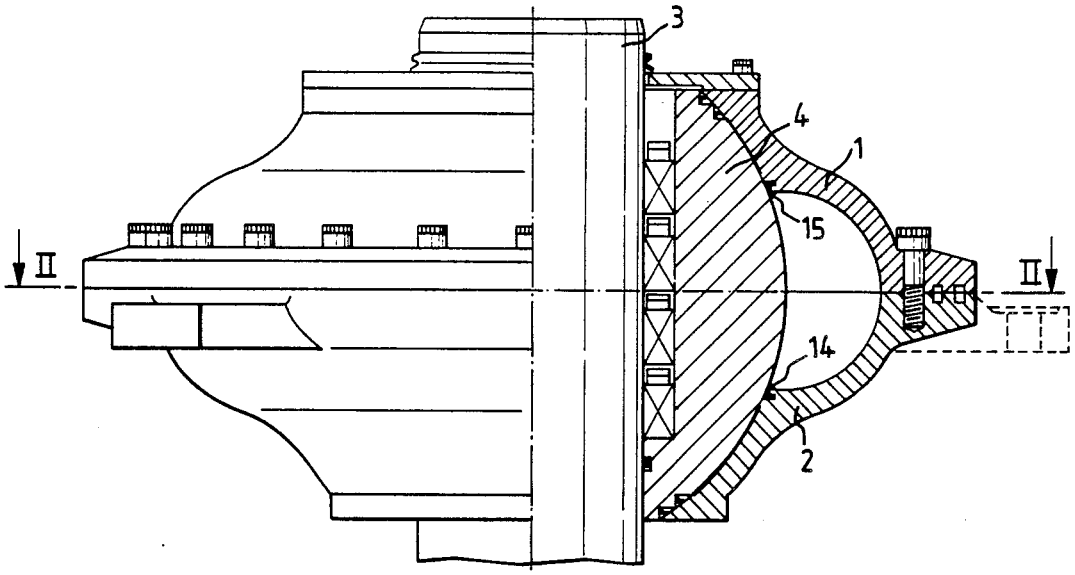
Figure 2:
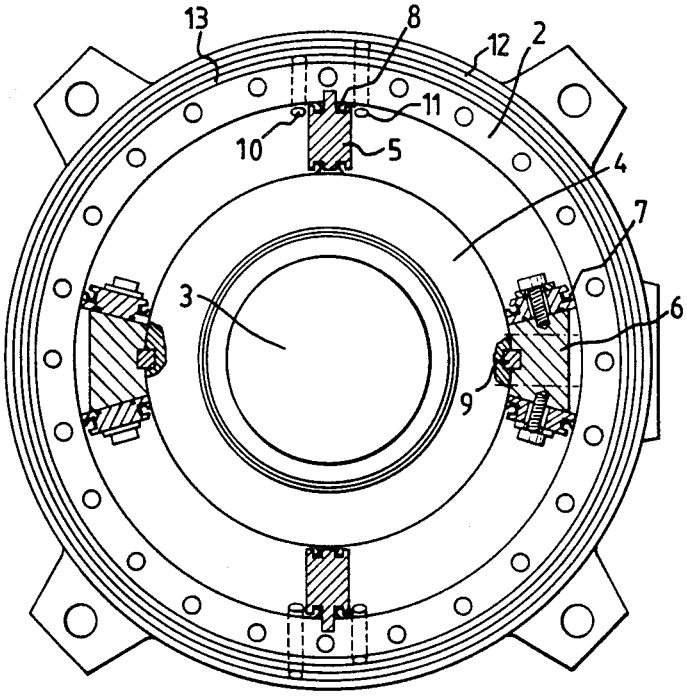

A ball shaped hub 4 is in a known manner secured to the rudder stock 3 as part of the upper bearing of the rudder stock. The ball shaped hub 4 is journalled with correspondingly shaped bearing shelves provided in a housing having an lower part 2 connected with the hull of the ship, and an upper part 1 secured to the lower part. Circumferencially arranged around the ball shaped hub 4 is a torus shaped guiding path formed by corresponding concavities in the upper part 1 and the lower part 2. Radial inwardly the guiding path is defined by the ball surface of the ball formed hub 4. The rudder stock 3 can be turned around its axis at the bearing of the ball shaped hub 4 in the upper part and the lower part and the bearing as such also can adapt an angle position of the rudder stock in relation to the middle axis between upper and lower bearing of the rudder stock, such as due to forces against the rudder itself.

A annular packing 15 is arranged between the upper part 1 and the ball shaped hub 4, provided with a lip abutting the upper part and a lip abutting the hub. Correspondingly an annular packing 14 is arranged such that one lip is abutting against the ball shaped hub 4 and one lip is abutting against the lower part 2. Due to the annular packings 14 and 15 the guiding path thereby in a secure way is tight as the tightening function is increasing by increasing pressure of the fluid provided in the guiding path.

At least one fixed partition wall 5 is arranged in the guiding path, being fixedly connected with the upper part 1 and the lower part 2. The partition walls 5 comprise wings or seals 8 protruding to both sides and abutting tightly against the circumferencial surface of the guiding path. Furthermore at least one carrier 6 is arranged between the fixed partition walls 5, being provided with wings or seals 7 protruding to both sides and abutting tightly against the circumferencial surface of the guiding path, whereby the wings being secured to the carrier and displaceable in the guiding path together with the carrier. In its described manner it is possible to move the ball shaped hub 4 and the carriers 6 in relation to the upper and lower parts, whereby the wings 7 are kept tightly in position in the guiding path by the circumferencial portions of the wings. Between each fixed partition wall 5 and each carrier 6 a space is created in the guiding path which can be pressurized or depressed through fluid conducts leading to openings 10, 11 in such a way that at least one space can be pressurized whereby the adjacent space is depressurized, thereby to press the carriers 6 away from the fixed partition walls 5, correspondingly and simultaneously thereby to turn the rudder stock 3.

By forming the ball shaped hub 4 as an integrated part of the guiding path and the arrangement of the guiding path closely to the bearing shelfs of the upper and lower parts, a very space saving design is achieved additionally to a very simple construction.

I claim:

1. Hydraulic actuator for turning movement of a spindle, especially a rudder (3), comprising a housing having a lower part (2) adapted to be fixed to the ship hull and an upper part (1) adapted to be secured to the lower part, a ball shaped hub journalled slideably in the lower and upper housing parts, which together define a substantially torus shaped guiding path, the rudder extending through the hub and secured thereto for rotation therewith about its axis, at least one partition wall (5) connected to the housing and arranged in and having seals (8) abutting tightly to the guiding path, at least one carrier (6) arranged in the guiding path and having seals sliding tightly against the guiding path, and fluid conduit means leading to each side of each partition wall (5) for alternatively pressurizing or depressing the two spaces intermediate the partition wall and carrier on both sides of the partition wall, said hub being fixed to the carrier for rotation therewith but free to rotate with respect to the carrier about an axis transverse to the axis of rotation of the rudder.

2. An actuator according to claim 1, wherein one packing ring (15) is arranged such that one lip is abutting against the ball shaped hub (4) and one lip is abutting against the upper part (1), and another packing ring (14) is arranged such that one lip is abutting against the ball shaped hub (4) and one lip is abutting against the lower part (2).

* * * * *